US006073409A

United States Patent [19]

Chambers

[11] Patent Number: 6,073,409

[45] Date of Patent: Jun. 13, 2000

[54] FLOORING CONSTRUCTION WITH CAPACITY FOR DEFLEXURE ADJUSTMENT

[76] Inventor: Robert X. Chambers, 1623 Margo La., West Chester, Pa. 19380

[21] Appl. No.: 09/182,793

[22] Filed: Oct. 30, 1998

[51] Int. Cl.[7] ..... E04F 13/08

[52] U.S. Cl. ..... 52/403.1

[58] Field of Search ..... 52/506.5, 509, 52/403.1, 512; 472/92

[56] References Cited

U.S. PATENT DOCUMENTS

| | | | |
|---|---|---|---|
| 2,317,015 | 4/1943 | Allen | 52/512 |
| 2,317,428 | 4/1943 | Anderson | 52/509 |
| 2,368,620 | 2/1945 | Strom | 52/509 |
| 2,539,038 | 1/1951 | Shumaker | 52/506.05 |
| 3,271,916 | 9/1966 | Omholt | 52/393 |
| 3,577,694 | 5/1971 | Omholt | 52/509 |
| 3,713,264 | 1/1973 | Morgan, Jr. | 52/489 |
| 5,016,413 | 5/1991 | Counihan | 52/391 |
| 5,647,183 | 7/1997 | Counhihan | 52/506.05 |

*Primary Examiner*—Beth A Aubrey
*Assistant Examiner*—Dennis L. Dorsey
*Attorney, Agent, or Firm*—Anthony J. McNulty

[57] ABSTRACT

A resilient flooring construction having a capacity for downward deflexure which comprises, as part of its sub-floor assembly, a plurality of elongated parallel supporting channel means having deflexure slots each of which are engaged by the top step member of a three member step-shaped anchoring clip which has a bottom step member fastened to a foundation outside the structural confines of the supporting channel, and a vertical riser member in the middle of the anchoring clip which limits the upward movement of the floor construction and permits its downward deflexure.

11 Claims, 4 Drawing Sheets

FLOORING CONSTRUCTION WITH CAPACITY FOR DEFLEXURE ADJUSTMENT

BACKGROUND OF THE INVENTION

1. History of the Technology

Gymnasium wood floors have been supported on spaced parallel metal c-shaped channels which are anchored inside the channel to secure them in a direct fixed relationship with a foundation, such as concrete. Flooring constructions in which the channel assembly is anchored firmly to a foundation surface are known in the industry as channel and clip floor systems. Such floors are characterized by their hold-down muscle in the presence of moisture; unfortunately, since the supporting channel itself is pinned flat down directly into a concrete foundation, the entire flooring system has no resiliency. The way the clip is pinned down inside the channel prevents it from having any vertical linear displacement, downward deflexure, or reciprocal up and down motion which restricts the resiliency of the whole flooring construction. On the other hand, there are floating floor systems, but they suffer from dead spots because they are not uniformly anchored. It is a goal of the flooring construction industry to provide a hardwood surface flooring construction which is anchored down to a foundation, but is capable of downward deflexure yet limits upward motion in response to expansion and contraction forces caused by moisture in the wood, and can react to certain other downward forces caused by highly compensated athletes who are often injured by unforgiving flooring construction.

2. Discussion of the Prior Art

The prior art has attempted to address the problem of providing a uniformly resilient flooring system. For example, Omholt U.S. Pat. No. 3,271,916 discloses a flooring system which comprises a plurality of parallel channels secured to a supporting base in which floor boards are secured by connector clips onto the channel and splines which engage the boards which are interposed between the channels. Omholt was attempting to resolve the problem of deflexure when a load was applied at the mid-channel point rather than being applied directly over the channels. To do this, Omholt interposed a shock absorbing material between the lower face of the channel and the supporting base material such as concrete. He also provided shock absorbing material in the void space between the channels and in void spaces between the under faces of the floor boards and the upper face of the supporting base material. In a fashion which is typical of prior art teachings, Omholt disclosed a flooring system which used spaced apart parallel steel channels which were secured to a foundation by means of headed fasteners which were driven through the channels into the foundation material; he used fastening clips to lock the channels directly to the floor system.

Morgan U.S. Pat. No. 3,713,264 discloses a flooring system in which the flooring boards are located in side-by-side relationship on a support with clips having fingers that engage the boards and secure the boards on the support. This securing clip is connected on one end inside a c-channel and has a finger which fits on the other end inside of the groove which is formed on one side of the board. Morgan also fastens his channel directly into a foundation so that the channel can not move. Abendroth U.S. Pat. No. 4,589,243 placed an underlayment on a foundation with a series of parallel grooves in the underlayment with support members in the grooves and floor boards superimposed on the support members and the underlayment with strips of compressed rubber between the floor boards and the underlayment and between the grooves and fasteners for fastening the floor to the support members. Abendroth also permanently fixed and secured his steel channels to the foundation by means of anchors driven through the channels into the foundation so that the channel could not move.

Counihan U.S. Pat. No. 5,016,413 recognized that resiliency is lost when the c-shaped channel is nailed directly into the foundation. To provide more resiliency, he used a resilient sub-floor section underneath the sub-flooring sections, but he still fastened his channel directly into the foundation material so that the channel could not move. Later, Counihan U.S. Pat. No. 5,497,590 disclosed a sub-floor assembly which permitted some limited vertical movement but again, he secured his channel assembly directly to a concrete base floor so that the channel itself was fixed and immovable. There is no teaching in the prior art which discloses a resilient flooring construction which comprises sub-floor channels which are capable of reciprocal up and down motion relative to its anchoring point into the support foundation.

SUMMARY OF THE INVENTION

The resilient flooring construction of this invention has a capacity for downward deflexure in response to forces acting downward onto the playing surface of hardwood surface boards at the top of the floor construction. Below the surface of the floor is a sub-floor system which comprises a plurality of elongated spaced parallel supporting channel means on a foundation. The playing surface boards are superposed and transversely span the supporting channels which are not fastened directly to the foundation. The channels are indirectly secured to the foundation and are engaged by step-shape three member anchoring clips which engage the channels through a deflexure slot cut in a vertical side panel of the channel. This indirect engagement of the channel to the foundation permits the channel to move downward along the vertical member of the anchoring clip. The entire assembly of flooring members are permitted to move down and up along the vertical height of the riser member of the anchoring clip of this invention because the top step member of the anchoring clip has two open slots which engage inside the vertical side panels of the channel on each side of the deflexure slots in the sides of the panels. The engagement of the top step member of the anchoring clips to the supporting channels through their deflexure slots (11 and 15) may be readily understood by referring to FIGS. 4, 5, 6, and 7 hereof.

The upper finished hardwood surface of the floor assembly is fixed firmly to the plurality of elongated channels by means of a surface board-attaching clip system in which the upper wood floor boards have clip-receiving locking grooves below the tongue of the wood board to fasten the floor boards to the c-channel and achieve a unitized system. An example of such a board fastening-clip and channel system for fastening the upper wood floor boards to the channel is shown in FIG. 1 of Morgan U.S. Pat. No. 3,713,264 which shows the board-attaching clip 34 engaging the channel 32 and the clip fingers 44 received by grooves 22 in the floor boards. The board-attaching clips are not claimed in this invention which discloses a novel anchoring clip.

The supporting channel of this invention is mounted onto a resilient cushion material, such as a rubber pad, which gives extra resiliency to the entire flooring construction, especially in combination with the independent downward deflexure movement of the slotted channel which travels along the boundaries of the vertical riser member of the anchoring clip. The forces acting on the floor push the supporting channel down into the rubber pad, and it then rises back up along the riser and slotted ear members of the anchoring clip.

The distance of the vertical downward deflexure of the channel depends on factors, such as the height of the vertical riser member of the anchoring clip, and the height of the deflexure slot in the vertical side of the channel, and on the height or thickness of the rubber pad cushion placed under the bottom surface of the channel between the channel and the foundation surface. The bottom step members of the anchoring clips are fastened to the foundation outside of and not inside the channel; an aperture in the shape of a round eye slot is located at the center of the bottom step of the anchoring clip so that a pin can be driven through the aperture to fasten it to the concrete foundation. The anchoring clip can be formed for a direct center insertion into the deflexure slot in the channel, such as shown in FIGS. 4 and 5, or an indirect twist-side insertion, such as shown in FIGS. 6 and 7. The anchoring clips are spaced apart longitudinally on opposite sides of each elongated channel in sufficient number to provide the maximum holddown strength for the flooring construction. Staggering the location of the anchoring clips so that they do not form uniform gridiron row patterns also reduces the likelihood of cracking the concrete foundation when fastening pins are driven through the aperture in the bottom step of the anchoring clips.

The height and width of the deflexure slot cut into the channel will be sufficient to accommodate the dimensions of the top step member of the anchoring clip which passes through the slot. The height of the resilient rubber pad under the channel will also affect the height of the deflexure slot. The deflexure slot may be cut into the supporting channel on its bottom surface and at its two vertical raised side panel surfaces depending on the shape of the anchoring clip. Such deflexure slots will be cut in the same shaped design as the top step member of the anchoring clip permitting its penetrating engagement with the deflexure slot. For a full center insertion, as illustrated in FIGS. 4 and 5 hereinbelow, the comparable rectangular slot may be cut either at the top of the vertical side panel of the channel, or at bottom surface of the channel between its two sides, such as shown in FIGS. 4 and 5, or the deflexure slot can be shaped for a side-twist anchoring clip as shown in FIGS. 6 and 7. The scope of this invention is not limited by the specific location of where the deflexure slot is cut in the channel.

The top step member of the anchoring clip is also referred to hereinafter as an ear or tongue member; this is the section of the clip which is inserted into the deflexure slot of the channel. The ear at the top of the clip has two opposing open slots at its transverse right angle junction with its middle riser section; said ear member has two open slots which have ends that are set against the inner surface of both sides of the deflexure slots in the sides of the channels and this engagement between the ears of the clip to the sides of the channel holds the entire flooring assembly in place when activated by upward or downward pressure on the upper surface wood flooring. The engagement of the ear member of the anchoring clip with the side panels defining the channel's deflexure slot gives the flooring construction its strength in the presence of external forces and internal changes caused by moisture, and holds the channel and its underlaying pad snug to the concrete foundation and helps eliminate dead spots.

DETAILED DESCRIPTION OF THE DRAWINGS

Figure 1:
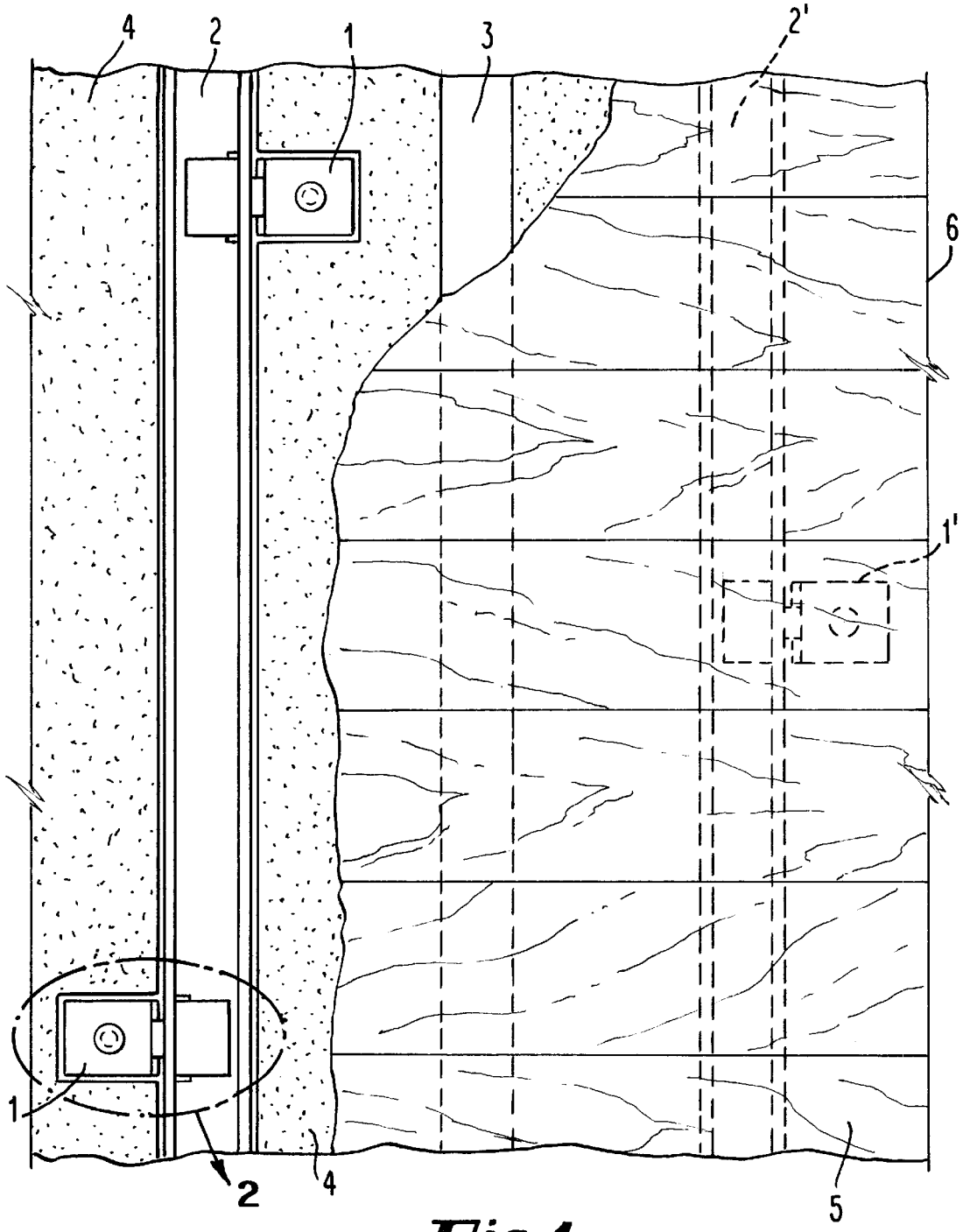
FIG. 1 is a sectional plane view looking down onto a flooring construction having an upper finished hardwood surface, and resilient sub-floor members which is secured to a foundation base surface.

FIG. 1 illustrates an outer wood surface flooring construction which comprises anchoring clip means (1) which engage with and secure elongated sub-floor supporting c-channel means (2) to a foundation substrate (9 in FIG. 3) onto which channel means is superposed a wood flooring superstructure to form a complete flooring construction (6). The anchoring clip means are placed at staggered spaced apart locations (1 and 1') along the opposite sides of a plurality of channel means (2 and 2'). The subfloor includes air slots (3) defined between adjacent sub-floor members (4) for ventilation of the construction to reduce the accumulation of water from moisture and condensation which causes the wood to warp. A high level resilient foamed material (4) or resilient rubber type materials, for example in the form of a rigid polyurethane foam pad member, is shown in parallel side-by-side elongated longitudinal relationship with the channel members. This highly resilient foam member provides some degree of resilience to the whole floor assembly.

Figure 2:
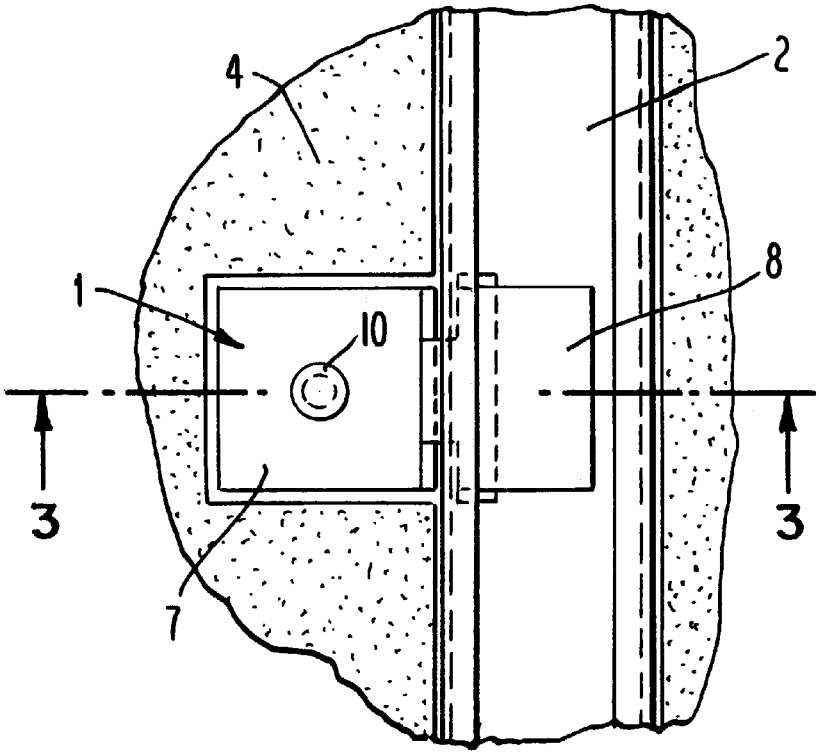
FIG. 2 is an enlarged plane view of an anchoring clip and supporting c-channel segment shown at the lower left section of FIG. 1 which section is highlighted within a circle marked with the numeral 2.
Figure 3:
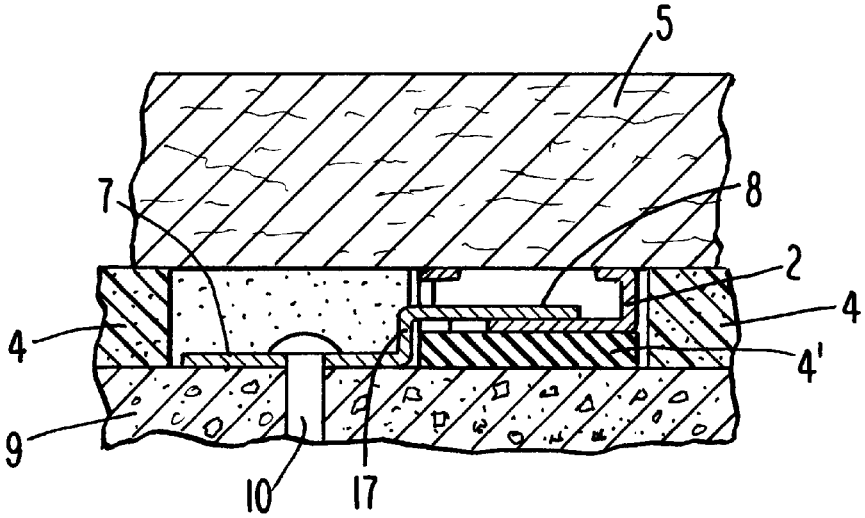
FIG. 3 is a cross-section view of an anchoring clip and c-channel segment in FIG. 2 along line 3—3.

FIG. 2 shows the anchoring clip means (1) in engagement with the channel member (2) in which an ear member (8) of said clip passes into and through a deflexure slot (11 of FIG. 4) in said channel, and in which a bottom-step member (7) of said clip is fastened by means of a pin (10) to a foundation (9 in FIG. 3).

FIG. 3 shows in cross-section along line 3—3 of FIG. 2 that the bottom horizontal step member (7) of the anchoring clip is fastened by means of pin (10) to substrate (9), and the top horizontal step member (8) of the clip is engaged through the deflexure slot of a raised side panel member of the channel (2) at the vertical height of the vertical riser member (17) of the clip. The channel member (2) is placed on top of a lower level resilient, flexible cushion material (4'), such as a rubber pad. The wood floor outer surface material (5) is placed transversely at right angles on top of the higher resilient foam member (4), and the channel members (2) and fastened to the channel using the aforementioned conventional attachment clips of Morgan for fastening the channels to the wood floor boards. The rubber pads 4' which are directly under the channel 2 give extra resiliency to the construction when the channel is pressed down into the pads.

Figure 4:
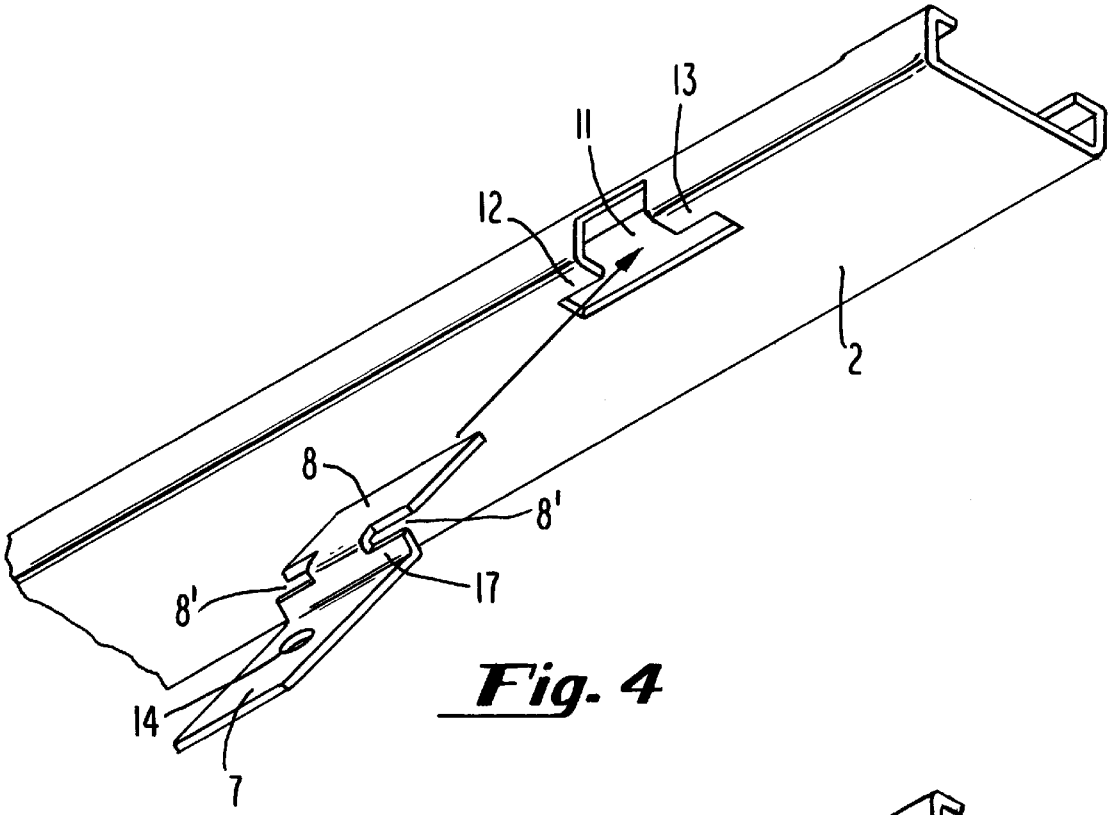
FIGS. 4 and 5 are perspective views of an anchoring clip and c-channel combination which provides engagement means for securing a flooring construction to a base surface, such as a concrete foundation, which permits the c-channel to engage in downward deflexure motion within limits described herein which imparts resilience to the whole flooring construction.

FIG. 4 illustrates the design of the three member step-shaped anchoring clip (numeral 1 in FIG. 1); this clip engages the channel (numeral 2 in FIG. 1). The anchoring clip comprises a body having a first horizontal flat surface top step member (8), a second vertical flat surface middle riser member (17), and a third horizontal flat surface bottom step member (7); said top step member having the shape of an ear with an outside end and an inside end which terminates at two open slots (8') which are located opposite each other at the junction of said first member (8) and second member (17) at which said first member extends transversely at a right angle from the top of said second member in a first horizontal direction; and said third member (7) comprises a horizontal flat rectangular surface having an aperture in the form of a round closed eye slot (14) at its center which third member extends transversely at a right angle from the bottom of said vertical second riser member in a second horizontal direction facing opposite from said first member. FIG. 4 further illustrates the method for the engagement of the top step (8) of the anchoring clip through deflexure slot 11 with the vertical side member of the channel.

Figure 5:
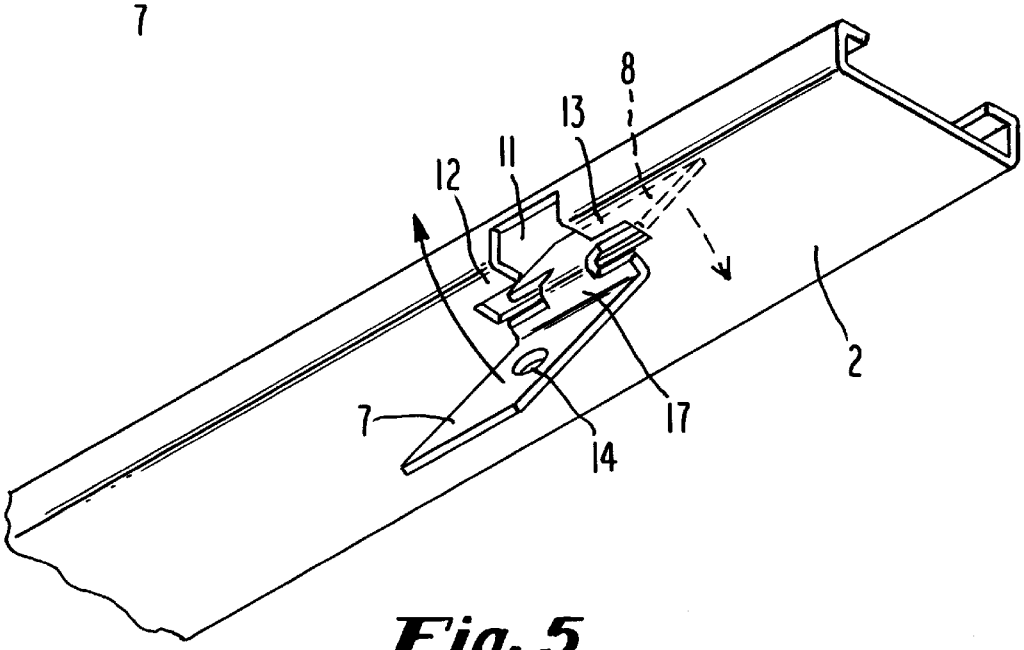

As shown in FIGS. 4 and 5 when the deflexure slot 11 is formed with a set-back from the side panel it forms two ledges 12 and 13 in the channel at the junction of the horizontal bottom surface of the channel and its raised vertical side panels. During the initial installation phase of the floor construction, after the top step member of the clip is inserted inside the channel at its deflexure slot, it is retained and supported at the inner edges of the clip's two open slots 8' which bear on the channel's two bearing ledges 12 and 13 on each side of slot 11; this avoids the clip falling out of the channel. The method of assembly for interlocking the clip and channel assembly is shown more fully in FIG. 5 of the drawings. In an alternate embodiment of this invention, the slot 11 is located at the top of the vertical side panel members of the c-channel instead of at the bottom horizontal surface member of the channel.

Depending on the particular conditions of the flooring construction and installation, the deflexure slots may be shaped so that the clip enters into the channel either at the top of its vertical raised side panel, or at a recessed set-back point in the bottom horizontal surface of the channel. The vertical height of the slot cut into the vertical side panel of the channel permits the channel to move up and down along the height of the vertical middle riser member of the clip means so that it moves while engaged by the riser in a reciprocal up and down straight line motion limited in upward movement by the vertical height (17) of the clip, and in its downward movement by the resilient pad 4' under the channel's bottom surface.

Figure 6:
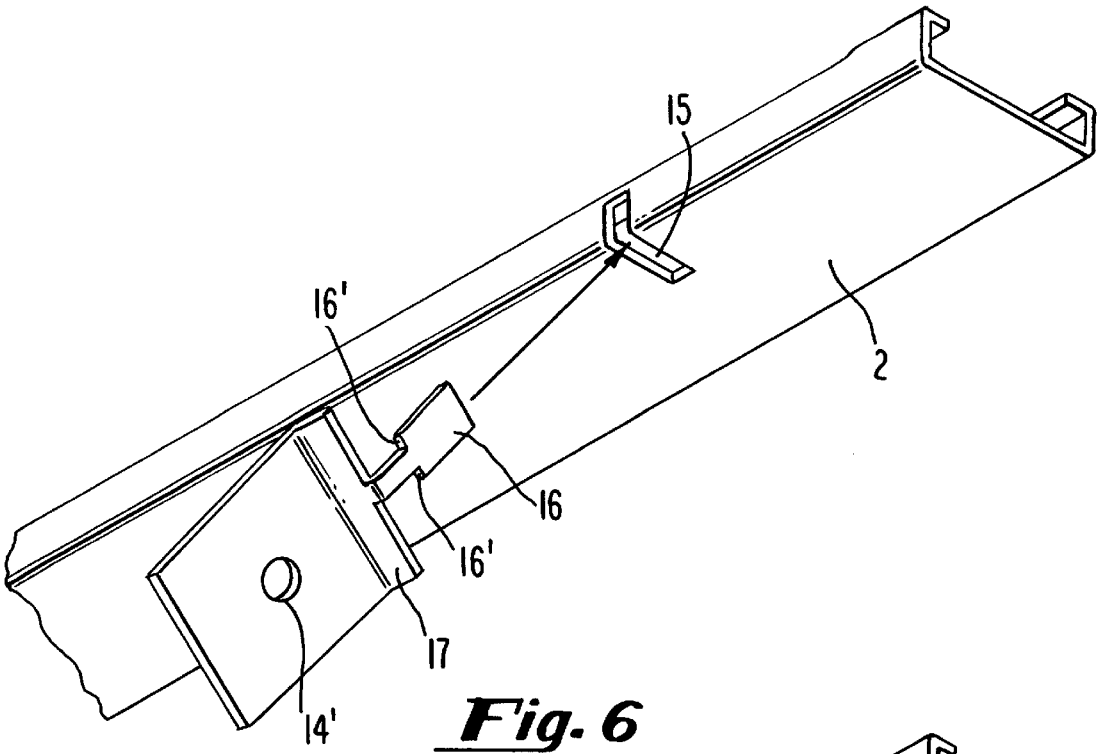
FIGS. 6 and 7 and perspective views of an alternate twist-mount anchoring clip and c-channel which provides engagement means for securing a flooring construction to a foundation base surface.
Figure 7:
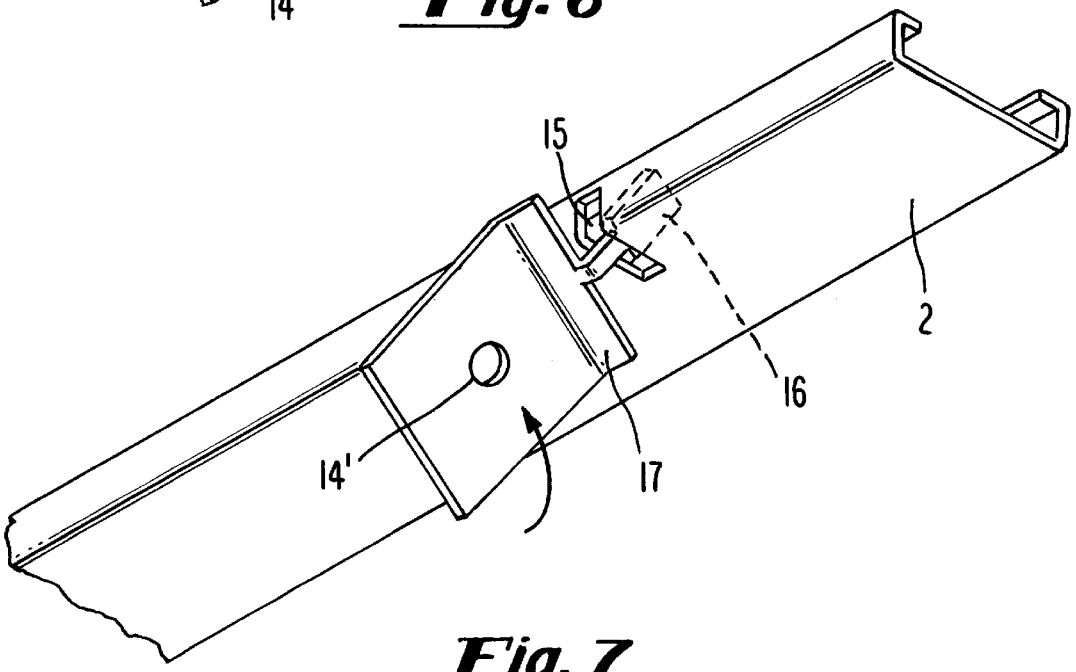

FIG. 6 illustrates a side-twist mount clip having a bottom horizontal rectangular step member (the same as 7 in FIG. 4) with an eye slot aperture 14', a vertical middle riser member 17, and a top step member 16 (the same as 8 in FIG. 4) having two opposing slots 16' at its junction with its vertical riser member. The clip is twisted on its side as shown in FIG. 7 and inserted into the elongated deflexure slot 15 in the channel 2 as shown in FIGS. 6 and 7. The rectangular slot 15 is formed into the bottom surface of the channel and extends transversely at a right angle up the adjacent raised vertical side panel member of the channel. The top step member 16 of the clip is rotated 90 degrees and inserted through the elongated deflexure slot 15 in the channel. The channel is engaged at each side of its deflexure slot 15 by the edges of the slots 16' in the top step of the anchoring clip so that the channel can descend along the vertical riser member of the anchoring clip.

A skilled artisan may be able to use this disclosure to construct floorings which are not specifically described herein yet still be within the scope of the following claims which define this invention.

What is claimed is:

1. In a flooring construction which comprises a plurality of floor boards situated in side-by-side relationship superposed and transversely spanning a plurality of elongated spaced parallel supporting channel means on a foundation, and fastening means holding said floor boards to said channel means, the improvement for anchoring said channel means to said foundation which comprises a plurality of step-shaped anchoring clip means comprising a first horizontal flat surface top step member, a second vertical flat surface middle riser member having two sides, and a third horizontal flat surface bottom step member; said top step member comprises an outside end and an inside end having two open slots located opposite each other at each side of said riser member at the junction of said first member and said riser member at which junction said top step member extends transversely from the top of said riser member in a first horizontal direction; said third member comprises a horizontal flat rectangular surface having an aperture for receiving fastening means, and which bottom step member extends transversely from the bottom of said riser member in a second horizontal direction facing opposite from the direction of said top step member; said supporting channel means having two vertical side panel members and a bottom panel member defined between said two sides in which at least one said vertical side panel comprises a deflexure slot means for engagement of said anchoring clip means with said channel means; said anchoring clip means having said top step members extending through said deflexure slots means in engagement therewith; and further comprises said bottom step members engaged by fastening means through said apertures with said foundation.

2. The flooring construction of claim 1 in which said bottom step member of said anchoring clip means is situated outside of the structure of said supporting channel means and is in engagement with said foundation.

3. The flooring construction of claim 1 in which said supporting channel means comprise deflexure slot means for permitting downward deflexure of said supporting channel means along said sides of said vertical riser member of said anchoring clip means but restricting upward movement to the level of the height of said vertical riser member of said anchoring clip means.

4. The flooring construction of claim 1 in which said anchoring clip means are spaced apart in a staggered longitudinal relationship along the length of said supporting channel means.

5. The flooring construction of claim 1 in which said anchoring clip means are spaced apart in a staggered longitudinal relationship along the length of and on opposite sides of said supporting channel means.

6. The flooring construction of claim 1 in which said supporting channel means are superposed on parallel strips of resilient pad material means located between the bottom surface of said channel means and said foundation.

7. The flooring construction of claim 1 which comprises a plurality of spaced parallel sub-flooring strips of resilient supporting inserts situated in alternate side-by-side relationship with said supporting channel means between said floor boards and said foundation.

8. The flooring construction of claim 1 which comprises a plurality of spaced parallel longitudinal air slot means defined between adjacent sub-floor members for circulating air inside said flooring construction.

9. In a resilient flooring construction having a capacity for downward deflexure which comprises a plurality of floor boards situated in side-by-side relationship superposed and transversely spanning a plurality of elongated spaced parallel supporting channel means having a flat horizontal bottom surface defined between two vertical side panel members on a foundation, and fastening means holding said floor boards to said channel means, the improvement for anchoring said channel means to said foundation which comprises a plurality of step-shaped anchoring clip means comprising a first horizontal flat surface top step member, a second vertical flat surface middle riser member having two sides, and a third horizontal flat surface bottom step member; said top step member comprises an outside end and an inside end having two open slots located opposite each other at each side of said riser member at the junction of said first member and said riser member at which junction said top member extends transversely from the top of said riser member in a first horizontal direction; said third member comprises a horizontal flat rectangular surface having an aperture for receiving fastening means, which bottom step member extends transversely from the bottom of said riser member in a second horizontal direction facing opposite from the direction of said top step member; said two vertical side panel members having deflexure slot means for permitting downward motion of said construction in which said deflexure slot means are in engagement with said top step member of said anchoring clip means; and further comprises said bottom step members in engagement by fastening means through said apertures with said foundation.

10. The resilient flooring construction of claim 9 in which said supporting channel means are anchored by said anchoring clip means to said foundation outside of the structural confines of said channel means.

11. The resilient flooring construction of claim 9 which comprises parallel strips of resilient pad material means on said foundation coextending under said supporting channel means so that said strips of resilient pad material are between said bottom surface of said channel means and said foundation.

* * * * *